US012403369B2

(12) United States Patent
Fujikake

(10) Patent No.: US 12,403,369 B2
(45) Date of Patent: Sep. 2, 2025

(54) INTERACTIVE VOLLEYBALL LAUNCHER SYSTEM

(71) Applicant: Daniel Nobuyoshi Fujikake, Honolulu, HI (US)

(72) Inventor: Daniel Nobuyoshi Fujikake, Honolulu, HI (US)

( * ) Notice: Subject to any disclaimer, the term of this patent is extended or adjusted under 35 U.S.C. 154(b) by 0 days.

(21) Appl. No.: 18/656,183

(22) Filed: May 6, 2024

(65) Prior Publication Data

US 2024/0374978 A1 Nov. 14, 2024

Related U.S. Application Data

(60) Provisional application No. 63/564,472, filed on Mar. 12, 2024, provisional application No. 63/465,485, filed on May 10, 2023.

(51) Int. Cl.

| | |
|---|---|
| ***A63B 69/00*** | (2006.01) |
| ***A63B 63/08*** | (2006.01) |
| ***A63B 69/40*** | (2006.01) |

(52) U.S. Cl.

CPC ..... *A63B 69/0095* (2013.01); *A63B 63/08* (2013.01); *A63B 69/407* (2013.01); *A63B 2210/50* (2013.01)

(58) Field of Classification Search

CPC ..... A63B 69/0095; A63B 67/002; A63B 2102/02; A63B 2102/16; A63B 2243/0095; A63B 69/407; A63B 69/409; A63B 63/08; A63B 2210/50

See application file for complete search history.

(56) References Cited

U.S. PATENT DOCUMENTS

| | | | | | |
|---|---|---|---|---|---|
| 221,694 | A | * | 11/1879 | Muholland | A63B 69/408 124/16 |
| 1,175,035 | A | * | 3/1916 | Wooster | F41B 3/00 279/23.1 |
| 2,891,795 | A | * | 6/1959 | Glintz | F41B 7/08 124/31 |
| 3,207,144 | A | * | 9/1965 | Soderman | F41J 9/18 124/35.1 |

(Continued)

FOREIGN PATENT DOCUMENTS

| | | | |
|---|---|---|---|
| CN | 202044741 U | * | 11/2011 |
| CN | 206434816 U | * | 8/2017 |

(Continued)

OTHER PUBLICATIONS

CN 110302522 A (Year: 2019).*

(Continued)

*Primary Examiner* — Eugene L Kim
*Assistant Examiner* — Amir A Klayman
(74) *Attorney, Agent, or Firm* — Batt IP A Law Corporation; Richard Batt

(57) ABSTRACT

An automatic volleyball feeder system for setting a volleyball in the air to a player includes a volleyball launcher and a basket assembly. The volleyball launcher comprises an actuator assembly in cooperating engagement with the basket assembly to activate the actuator when a volleyball is received by the basket assembly. The launcher sends the volleyball along a consistent trajectory. The launcher is configurable to modify the height and angle of the trajectory.

15 Claims, 11 Drawing Sheets

(56) References Cited

U.S. PATENT DOCUMENTS 3,545,752 A * 12/1970 Hill ..... A63B 69/407 124/16
3,611,996 A * 10/1971 Wegner ..... A01K 15/025 124/36
3,635,204 A * 1/1972 Plumb, Jr. ..... F41J 9/18 124/43
3,770,272 A * 11/1973 Olivier ..... A63F 9/02 124/16
3,794,325 A * 2/1974 Stender ..... A63F 9/02 124/36
3,856,300 A * 12/1974 Payne ..... A63B 69/407 124/16
3,926,170 A * 12/1975 Dixon ..... A63B 69/408 124/80
D249,287 S * 9/1978 Strout ..... D21/720
4,164,928 A * 8/1979 Meares ..... A63B 65/122 124/16
4,261,319 A * 4/1981 Dixon ..... F41B 3/005 124/35.1
4,714,069 A 12/1987 Ulrich
4,860,717 A * 8/1989 Powell ..... A63B 69/408 124/36
5,087,054 A * 2/1992 O'Neil ..... A63G 31/08 273/384
5,294,109 A * 3/1994 Meade ..... A63B 69/40 124/50
5,462,285 A * 10/1995 O'Patka ..... A63F 11/0011 124/16
5,485,994 A * 1/1996 Underwood ..... A63B 63/00 473/451
5,575,482 A * 11/1996 Butler, Jr. ..... A63B 69/407 124/66
5,657,984 A * 8/1997 Leo ..... A63B 69/407 473/451
5,694,913 A * 12/1997 Parrott ..... F41B 3/02 124/35.1
6,019,096 A * 2/2000 Snyder ..... F41B 3/02 124/16
6,102,404 A * 8/2000 Barker ..... A63F 9/02 273/379
6,264,201 B1 * 7/2001 Holsten ..... F41J 5/18 273/384
6,546,923 B2 * 4/2003 Erickson ..... A63B 69/407 124/16
6,843,241 B1 * 1/2005 Newcomer ..... A63B 69/407 124/16
7,028,682 B1 * 4/2006 Hansen ..... F41B 7/00 124/16
7,458,907 B2 * 12/2008 Wang ..... A63B 69/0002 124/16
8,770,586 B2 * 7/2014 Kody ..... F41J 5/24 273/348
9,044,686 B2 * 6/2015 Aguila ..... F41B 7/08
10,265,598 B1 * 4/2019 Gagne ..... A63B 71/023
11,071,898 B2 * 7/2021 Cochran ..... A63B 71/023
2007/0010353 A1 * 1/2007 Huang ..... A63B 69/0002 473/417
2007/0072704 A1 * 3/2007 Wey ..... A63B 69/0002 124/4
2007/0298647 A1 * 12/2007 Lee ..... A63F 9/0204 439/354
2010/0187760 A1 * 7/2010 Hilbert, Jr. ..... A63B 67/06 273/332
2011/0303207 A1 * 12/2011 Shober ..... A63B 69/408 124/54
2021/0060391 A1 * 3/2021 Legg ..... A63B 47/021
2022/0126186 A1 * 4/2022 Clements ..... A63B 69/407

FOREIGN PATENT DOCUMENTS

CN 108837457 A * 11/2018 ..... A63B 69/0095
CN 110302522 A * 10/2019 ..... A63B 69/0095
CN 111035910 A * 4/2020
DE 212020000566 U1 * 1/2022 ..... A63B 69/0095
KR 101569809 B1 * 11/2015 ..... A63B 69/400
WO 2021046902 A1 3/2021

OTHER PUBLICATIONS

CN 111035910 A (Year: 2020).*
CN 202044741 U (Year: 2011).*
DE 212020000566 U1 (Year: 2021).*
CN 206434816 U (Year: 2017).*
KR101569809 (Year: 2015).*
CN 108837457 A (Year: 2018).*
4Johor Volleyball Training Equipment, Est. Pub. Date at least as early as May 4, 2024.
AirCAT, Est. Pub. Date 1998.
Green Pitching Machine, Est. Pub. Date at least as early as May 4, 2024.
Siboasi, Est. Pub. Date 2018.
Smart Spike, Est. Pub. Date at least as early as May 4, 2024.
Sports Tutor, Est. Pub. Date at least as early as May 4, 2024.
Tansheep Volleyball Spike Trainer, Est. Pub. Date 2020.
The Edge, Est. Pub. Date 2016.
Total Attack, Est. Pub. Date 1998.
Volleyball Training Aid, Est. Pub. Date 2015.

* cited by examiner

INTERACTIVE VOLLEYBALL LAUNCHER SYSTEM

CROSS-REFERENCE TO RELATED APPLICATIONS

This claims priority to provisional patent application No. 63/465,485, filed May 10, 2023, and application No. 63/564,472, filed Mar. 12, 2024, both of which are entitled "Interactive Volleyball Launcher".

BACKGROUND OF THE INVENTION

This invention pertains to sports training equipment, specifically an interactive volleyball launcher.

Volleyball is played throughout the world by an estimated 500 million or more people. With volleyball's global popularity on the rise and competition intensifying across various age groups, there is a strong desire to master fundamental volleyball techniques such as passing, setting, and hitting.

Developing these skills starts early and requires hours of repetitive practice for seamless integration into players' natural coordination. Coaches, recognizing the importance of effective and enjoyable training, face a significant challenge. The inherent complexity of these techniques makes it difficult to delegate tasks to players or volunteer parents, compelling coaches to oversee drills personally, involving repetitive tasks like tossing or hitting hundreds of balls per practice session.

To address this challenge, several training tools have been introduced. However, these tools often have limitations such as impractical large size, too heavy, and/or a lack of dynamic interaction. Most are large heavy metal structures designed for stability that either hold a static ball in the air by elastic rope/padded arms or require electricity to propel the balls with motorized spinning wheels.

A problem with these training tools is that static aids fail to provide the dynamic interaction necessary to practice the approach. By holding the ball in one place, the training product needs to have the height of the ball adjusted according to the height/reach of the player, making it less useful for groups. The heavy large motorized units, although some are capable to launching a volleyball, have several shortcomings. They wear out balls quickly, are generally too big and heavy for an individual to move, much less quickly, and do interact based on receiving a pass from the player.

Accordingly, there is a need for an innovative alternative that addresses the above-mentioned shortcomings.

SUMMARY OF THE INVENTION

An embodiment of the invention is an automatic volleyball feeder system for sending a volleyball in the air along a parabolic trajectory for a player to hit. The feeder system comprises a volleyball launcher comprising an actuator assembly and a target assembly in cooperating engagement with the volleyball launcher to activate the actuator assembly when a ball is received by the target assembly. When activated, the volleyball launcher sends the volleyball into the air along the parabolic trajectory.

In embodiments of the invention, the target assembly comprises a basket.

In embodiments of the invention, the target assembly comprises a target surface arranged at the bottom of the basket such that a ball received by the basket is guided into contact with the target surface, and movement of the target surface arising from the contact activates the actuator assembly. Optionally, the target surface is a plate.

In embodiments of the invention, the system further comprises an extension member mechanically linking the actuator assembly and the plate of the target assembly.

In embodiments of the invention, the system further comprises a trigger adapter operable to adjust the elevation at which the extension member is coupled to the actuator assembly.

In embodiments of the invention, the feeder system further comprises a base assembly on which the volleyball launcher is rotatably mounted.

In embodiments of the invention, the actuator assembly comprises a non-electrical actuator, and in a preferred embodiment, a launcher spring provides launch force to a striker shaft.

In embodiments of the invention, the volleyball launcher comprises a priming lever for manually loading the actuator assembly to drive the striker shaft by compressing the launcher spring.

In embodiments of the invention, the actuator assembly further comprises clutch plates and trigger springs to releasably lock the striker shaft and launcher spring after the priming lever is released and until a trigger releases the launcher spring.

In embodiments of the invention, the volleyball launcher further comprises a hand-adjustable load control member to limit the launch force.

In embodiments of the invention, the feeder system further comprises a second volleyball launcher rotatably mounted to the base assembly.

In embodiments of the invention, the system comprises straps operable to set the volleyball launcher at a desired angle relative to the base assembly.

In embodiments of the invention, the volleyball launcher further comprises a ball holder shaped for (a) gripping the volleyball and (b) avoiding applying rotation to the volleyball as the volleyball is launched.

In embodiments of the invention, the spring force in the actuator is predetermined in the range to launch a volleyball from 10 to 20 feet in the air.

In embodiments of the invention, the target assembly is mounted to the base assembly. In embodiments of the invention, the volleyball launcher has a footprint ranging from 1-3 sq. ft. and in one embodiment, about 2 sq. ft.

In embodiments of the invention, the volleyball launcher and basket each have a weight less than 15 lbs., and in some embodiments, less than 10 lbs. The weight of the base can vary and, in some embodiments, has a weight greater than 20 lbs., and optionally, between 25-30 lbs.

In embodiments of the invention, the feeder system further comprises a backstop detachably connectable to the basket.

In embodiments of the invention, the volleyball launcher and target assembly comprise an operating configuration for play and a collapsed configuration different than the operating configuration for transportation or storage.

In embodiments of the invention, the launcher comprises a first portion that is insertable within a second portion to form the collapsed configuration.

In embodiments of the invention, the feeder system further comprises at least one air vent in the striker rod or shaft sleeve to reduce the pressure within the shaft cover as the shaft is launched upwards by the spring force.

In another embodiment of the invention, a volleyball feeder system comprises a volleyball launcher for sending the volleyball along a parabolic trajectory. The volleyball launcher comprises: base assembly; a tubular-shaped body tiltably mounted to the base assembly; a spring powered actuator assembly; a striker shaft arranged within the body, and coupled to the actuator assembly, and operable to be manually loaded; a volleyball holder arranged at the top of the striker shaft and shaped to hold a volleyball; and a trigger mechanically linked to a target surface such that contact of the target surface moves the trigger and wherein the trigger is operable with the actuator assembly to activate the actuator assembly, thereby releasing the loaded striker shaft and sending the volleyball from the volleyball holder along the parabolic trajectory.

In embodiments of the invention, the feeder system further comprises a collapsible net in the shape of a basket, wherein the target surface is arranged at the bottom of the basket when deployed, and wherein the target surface is mechanically linked to the trigger via an extension arm.

In embodiments of the invention, a basket assembly includes a collapsible metal frame that supports the net, and can be connected to the launcher base or used independently, depending on the drill.

In embodiments of the invention, the target surface is in the form of a rigid activator plate, optionally comprising at least one seam.

Objects and Advantages

Embodiments of the invention have a variety of objects and advantages.

Nonlimiting objects and advantages of some of the embodiments of the invention are described herein. However, it is intended that the invention be limited only as recited in the appended claims.

Embodiments of the invention provide an apparatus that is portable, fully mechanical (non-electrical) and can consistently and precisely deliver sets to a variety of selectable heights and angles producing an optimal set.

Embodiments of the invention provide a volleyball launcher that is designed to be light and portable, folding up for easy transportation, optionally, requiring less than a five-minute set up for a single person by hand.

Embodiments of the invention provide a training tool that is simple and safe enough for children to operate, affordable, portable, and offers dynamic training with precisely launched volleyballs.

Embodiments of the invention provide a launcher that can propel volleyballs in a fully adjustable, consistent trajectory, enabling dynamic training for passing, setting, and hitting.

Embodiments of the invention provide a launcher that can be used with a partner who semi-manually launches the volleyballs by pushing on the trigger of the actuator assembly, or independently with the activator basket, which automatically launches a volleyball when the weight of a tossed ball is detected in the basket.

Embodiments of the invention provide a launcher and basket that can be disassembled and easily transported in a car trunk, and light enough for a single person to carry.

Embodiments of the invention provide a mechanical priming mechanism that makes it easy and safe for young players to operate, in addition to being durable, and usable in areas without electrical power, such as outdoor courts or backyards.

Embodiments of the invention provide a pneumatic-free actuator. No pressurized cylinders are required or need to be charged.

Embodiments of the invention provide a system where a single player with a launcher can practice their hitting (and approach) to the ball launched by the launcher as well as their passing (or optionally setting to the basket) to trigger the launch.

Embodiments of the invention provide a system where two or more players with a launcher can additionally practice blocking or digging defense off the hit balls.

Other objects and advantages of embodiments of the present invention will become apparent from the following detailed description taken in conjunction with the accompanying drawings, which illustrate, by way of example, principles of embodiments of the present invention.

BRIEF DESCRIPTION OF DRAWINGS

Embodiments of the present invention are illustrated by way of example, and not by way of limitation, in the figures of the accompanying drawings in which.

Figure 1:
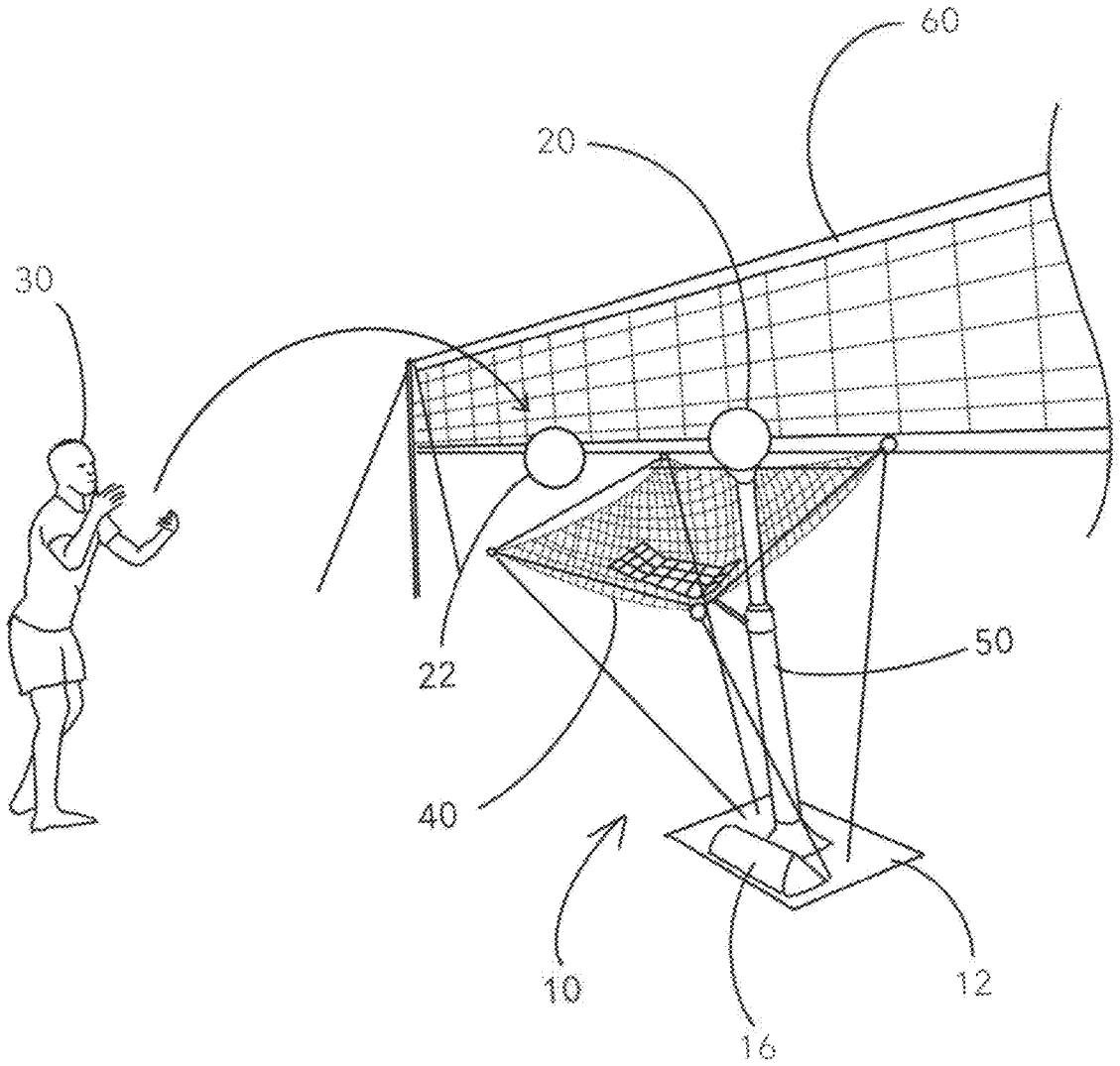
FIGS. 1-2 are sequential illustrations of a player using an interactive volleyball system to activate and set a volleyball in accordance with an embodiment of the invention.

The description, objects and advantages of embodiments of the present invention will become apparent from the detailed description to follow, together with the accompanying drawings.

DETAILED DESCRIPTION OF THE INVENTION

Before the present invention is described in greater detail, it is to be understood that this invention is not limited to particular embodiments described, as such can, of course, vary. It is also to be understood that the terminology used herein is for the purpose of describing particular embodiments only, and is not intended to be limiting, since the scope of the present invention will be limited only by the appended claims. Where a range of values is provided, it is understood that each intervening value, to the tenth of the unit of the lower limit unless the context clearly dictates otherwise, between the upper and lower limit of that range and any other stated or intervening value in that stated range, is encompassed within the invention. The upper and lower limits of these smaller ranges can independently be included in the smaller ranges and are also encompassed within the invention, subject to any specifically excluded limit in the stated range. Where the stated range includes one or both of the limits, ranges excluding either or both of those included limits are also included in the invention. Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, representative illustrative methods and materials are now described. It is noted that, as used herein and in the appended claims, the singular forms "a", "an", and "the" include plural referents unless the context clearly dictates otherwise. It is further noted that the claims can be drafted to exclude any optional element. As such, this statement is intended to serve as antecedent basis for use of such exclusive terminology as "solely," "only" and the like in connection with the recitation of claim elements, or use of a "negative" limitation. As will be apparent to those of skill in the art upon reading this disclosure, each of the individual embodiments described and illustrated herein has discrete components and features which can be readily separated from or combined with the features of any of the other several embodiments without departing from the scope or spirit of the present invention. Any recited method can be carried out in the order of events recited or in any other order that is logically possible.

All existing subject matter mentioned herein (e.g., publications, patents, patent applications and hardware) is incorporated by reference herein in its entirety except insofar as the subject matter may conflict with that of the present invention (in which case what is present herein shall prevail).

Overview

Figure 2:
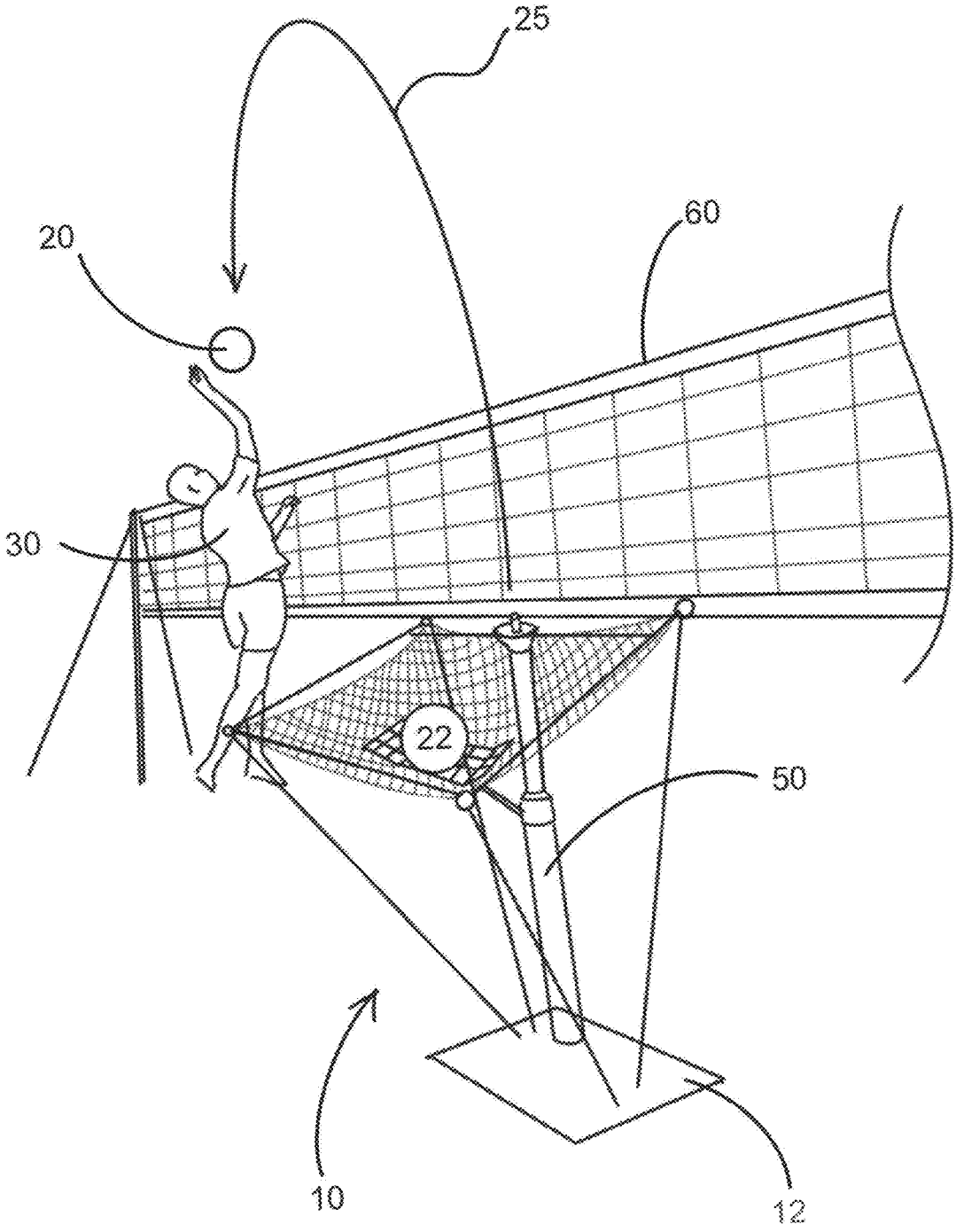

With reference to FIGS. 1-2, an interactive volleyball launcher system 10 in accordance with an embodiment of the invention is shown. System 10 can be used to mimic a setter in a common volleyball hitting drill. In an exemplary drill, a hitter initially tosses or passes a ball to the setter. The setter then sets the ball to the hitter to hit the ball over the net and onto the opponent's court.

In the system 10 shown in FIG. 1, a basket 40 and pre-loaded launcher 50 are mounted to a base assembly 12. A sandbag or weight 16 is optionally placed on the base assembly to stabilize the launcher as well as to secure the activator basket against the wind. The hitter 30 is shown tossing a second volleyball 22 into the basket 40.

With reference to FIG. 2, when the second ball 22 falls to the bottom of the basket 40, it activates the launcher 50 sending the first ball 20 along a parabolic trajectory 25 to a pre-selected position at a pre-determined height producing the desired set. As described herein, in embodiments, a trigger mechanism in the launcher 50 is activated by the weight of the ball contacting a trigger plate in the basket 40, thereby causing the volleyball 20 to be set.

Embodiment 1

Figure 3:
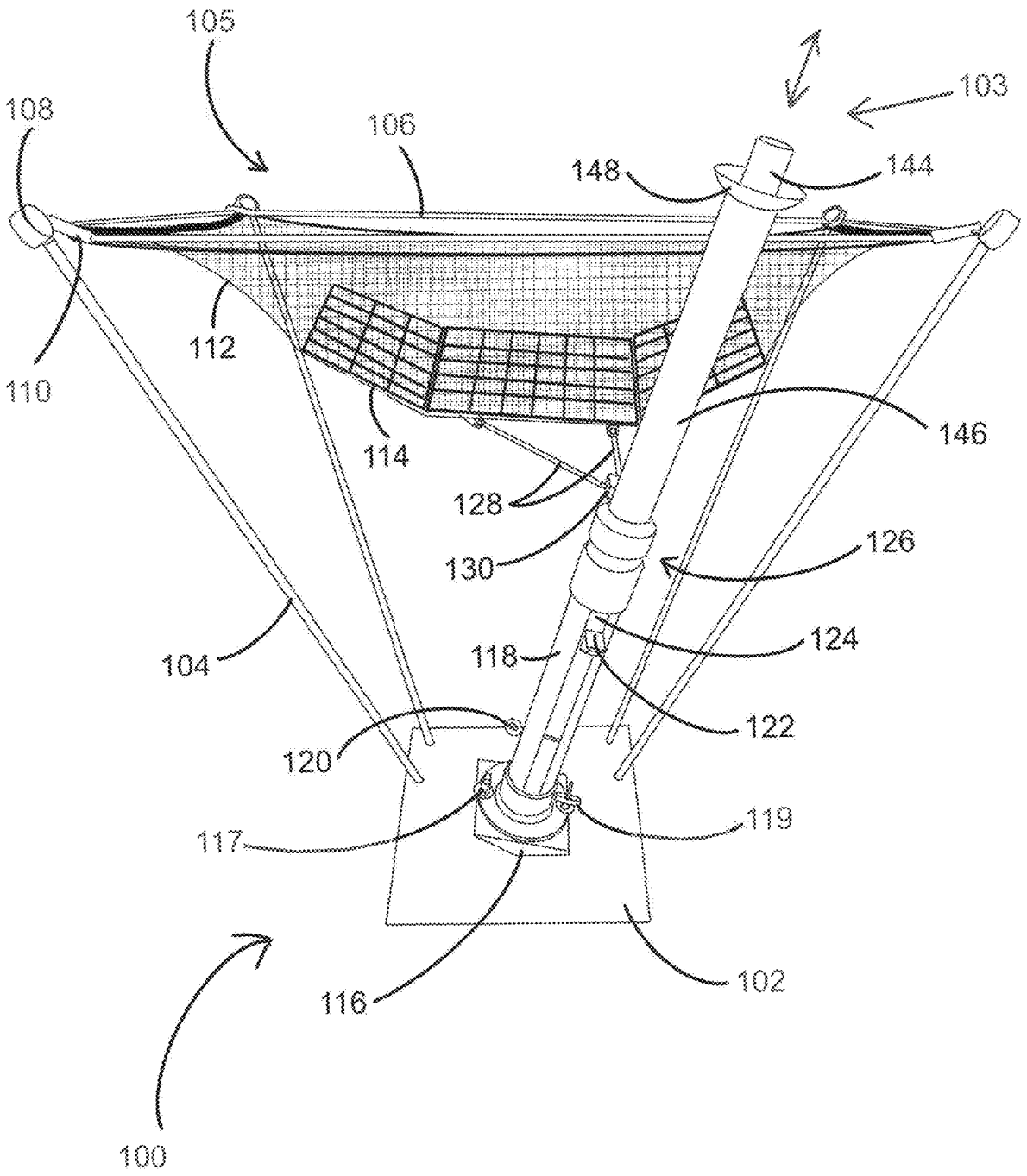
FIGS. 3-4 are upper rear and upper right-side perspective views of the interactive volleyball system shown in FIG. 1, respectively, in accordance with an embodiment of the invention.
Figure 4:
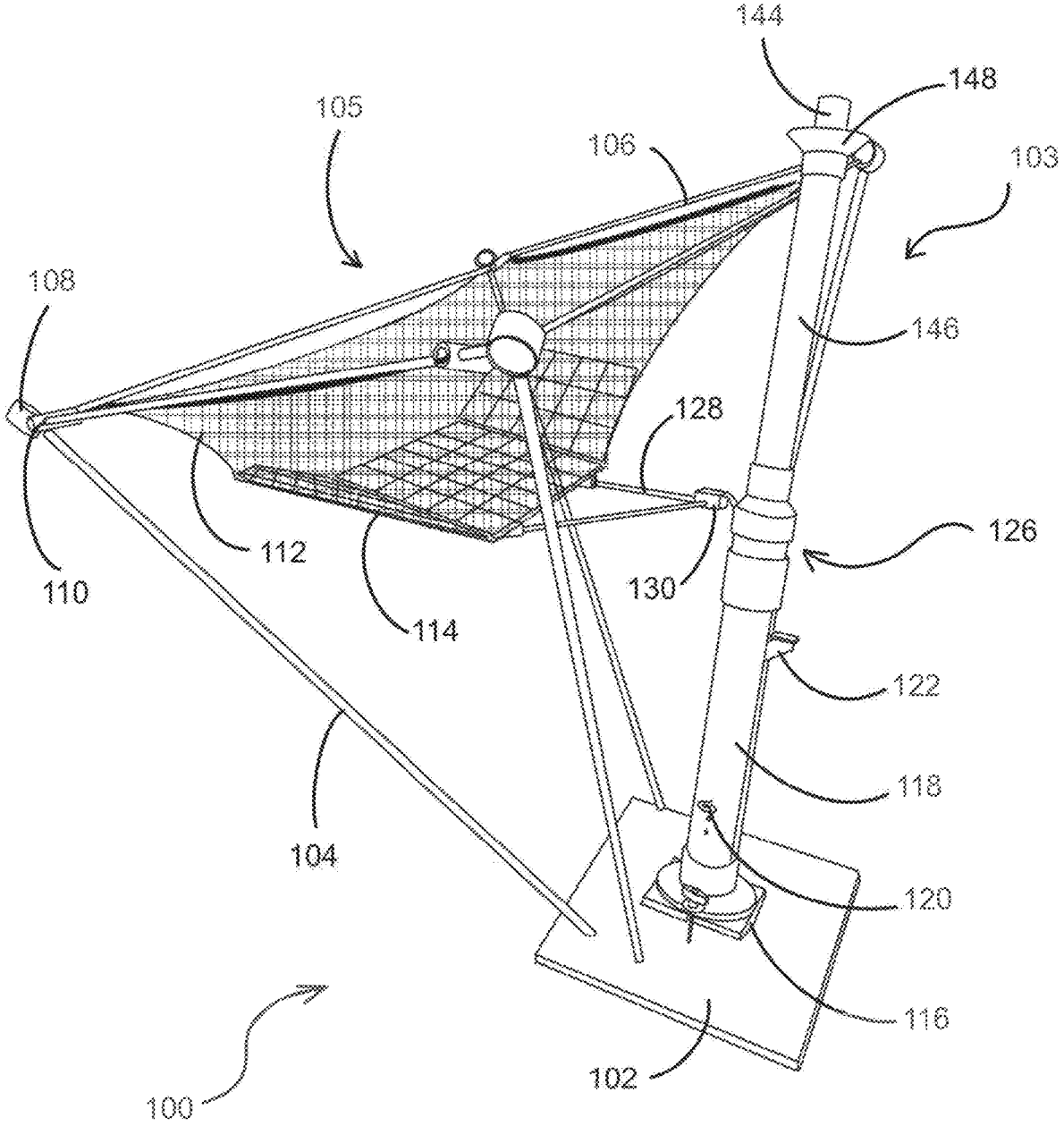

FIGS. 3-4 are upper rear and upper right-side perspective views of an interactive volleyball system 100, respectively, in accordance with an embodiment of the invention.

The system 100 is shown including a launcher assembly 103 and a basket assembly 105 both of which are mounted to a base plate 102.

The basket assembly 105 is shown including a net 112 supported by a plurality of arm members 106 which collectively form a net frame. The arm members are held together via arm connectors 110. The net frame is supported by a plurality of basket legs 104 extending from the base plate 102. The frame is attached to the legs via frame connectors 108.

A trigger plate 114 is arranged at the bottom of the basket 112. The trigger plate is shown having multiple sections divided by seams. The different sections facilitate conforming the target surface to the lower curvature of the net or as otherwise desired. The seams also allow the target plate to be collapsed into a smaller more portable configuration for transportation and storage.

The basket assembly 105 is also shown connected to the launcher assembly 103 by arm extensions 128. In particular, two arm extensions are shown extending from the trigger plate 114 to a trigger arm 130 of the launcher assembly. When the volleyball is collected by the net, the ball is gravity directed into the trigger plate 114 where the weight of the volleyball causes the trigger arm 130 to be deflected, thereby actuating the launcher assembly and setting the volleyball, as described further herein.

The tubular-shaped launcher assembly 103 shown in FIGS. 3-4 has an adjustable angle base 116, a launcher priming section 118, a trigger actuating section 126, a striker cover section 146, and an upper volleyball holder section 148.

In embodiments of the invention, the adjustable angle base 116 rests within a slot in the base plate 102 and allows the launcher assembly to tilt or pivot (e.g., left to right) up to a threshold angle (e.g., 10 to 30, or more preferably about 20 degrees) to deliver sets to either side of the court. Hand-tightened fasteners 117, 119 are shown to secure base at the desired angle.

The launcher priming section 118 is shown including a priming lever 122 in the form of a foot pedal. The priming lever 122 is vertically movable along a channel. A user can manually depress the priming lever 122 to load the actuator assembly 126, described herein. The launcher priming section 118 is also shown with a plurality of holes positioned vertically incrementally along its side for receiving a power selector pin 120. As described herein, the height of the launched balls can be adjusted based on which hole the power selector pin 120 is inserted. The pin 120, when deployed, limits travel of a striker rod 136 and deflection of the launcher spring 140, described herein.

A striker cover section 146 extends upwards from the actuator assembly 126. The striker covers section encloses the striker rod 136 and launcher spring 140.

A volleyball holder 148 is shown arranged at the top of the striker cover section for supporting a volleyball. Striker head 144 extends through the center of the volleyball holder 148 and is operable to push/punch the volleyball from the holder when activated. As described herein the striker head 144 is coupled to the striker rod 136, both of which are movable relative to the striker cover section 146 and the volleyball holder 148.

Actuator Assembly

Figure 5:
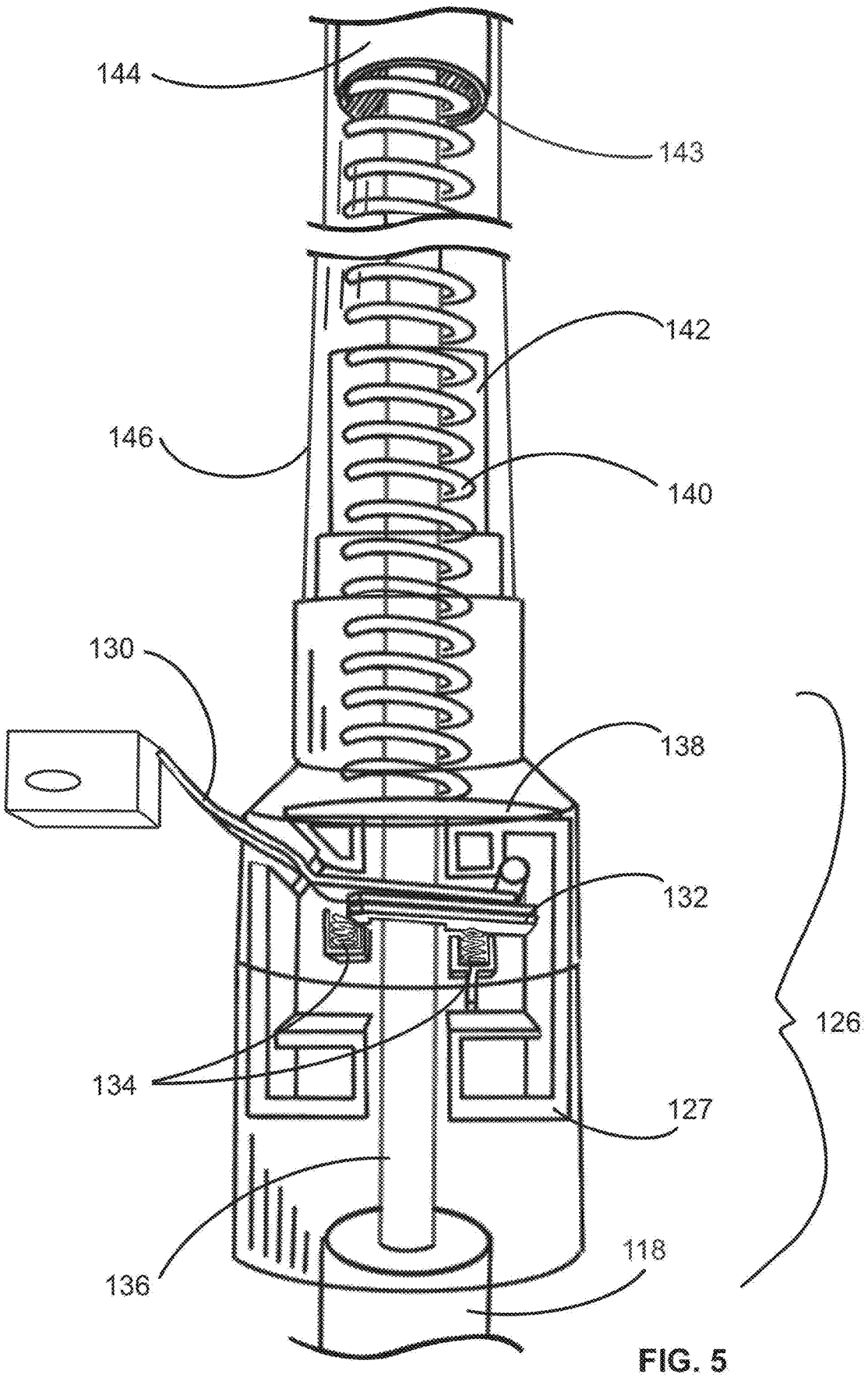
FIG. 5 is an enlarged partial side view of a volleyball launcher in accordance with an embodiment of the invention.

With reference to FIG. 5, an actuator assembly 126 is shown with a transparent cover for facilitating understanding of the internal components. The actuator assembly 126 includes a launcher spring 140 and striker arm 136. When loaded as described above by pushing the priming lever 122 downwards to a desired position, the clutch plates 132 and trigger springs 134 are operable to automatically lock the launcher spring 140 and striker arm 136 in place until the assembly is released by the activator/trigger arm 130. This spring assembly 134 provides constant tension on the clutch plates 132 which serve to apply constant braking on the striker rod 136 during priming (namely, loading) such that if a user's foot slips off the pedal 122 while priming, the launcher will not activate.

The striker rod 136 is fixedly connected to the striker head 144. The striker head includes a recess or region 143 to accommodate the upper end of the launcher spring 140, serving as an upper stop for the launcher spring 140, while a spring base 138 at the opposite end of the spring, serves as a lower stop.

The striker rod 136 and the priming foot pedal 122 move within the launcher priming section 118. Pressure applied to the priming foot pedal 122 compresses the launcher spring 140 between the lower stop 138 and upper stop 143. The foot pedal 122 can be depressed until it reaches the desired power select pin 120, or until the striker head 144 hits a spring load stop 142, preventing over-compression of the spring 140. When the actuator is fully compressed, the distance from the lower stop 138 to striker head 144 ranges from 2 to 8 inches, and more preferably ranges from 4-7 inches.

In embodiments, the striker head 144 is fitted to the interior dimension of the striker cover section 146 so that the striker head is guided to consistently contact the ball's center. The striker cover section 146 is coupled to the ball holder 148, which firmly centers a ball to the end of the striker cover section 146, and prevents movement from external forces (e.g., wind).

Embodiment 2

Figure 6:
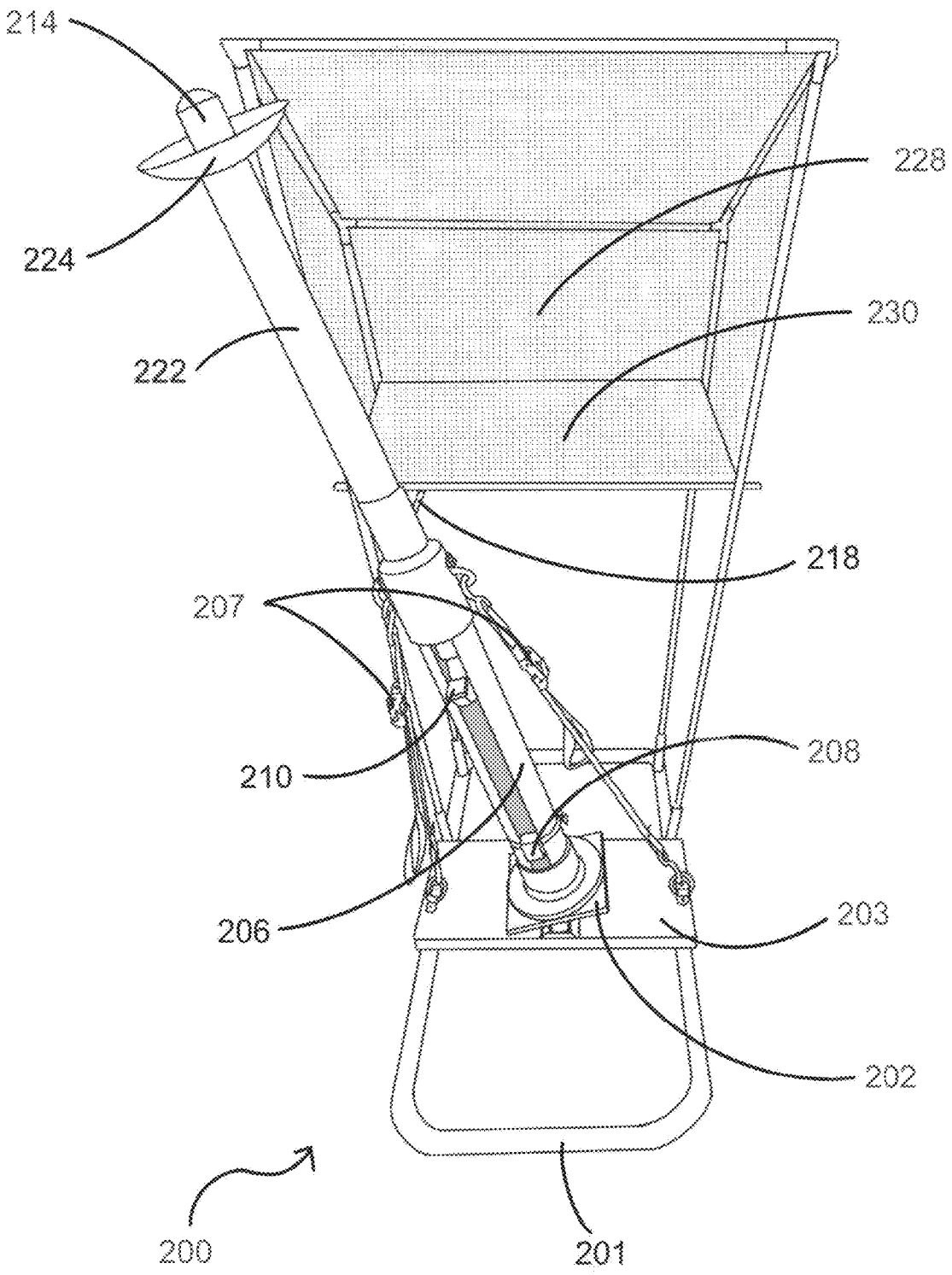
FIGS. 6-7 are upper rear and upper left-side perspective views of an interactive volleyball system, respectively, in accordance with another embodiment of the invention.
Figure 7:
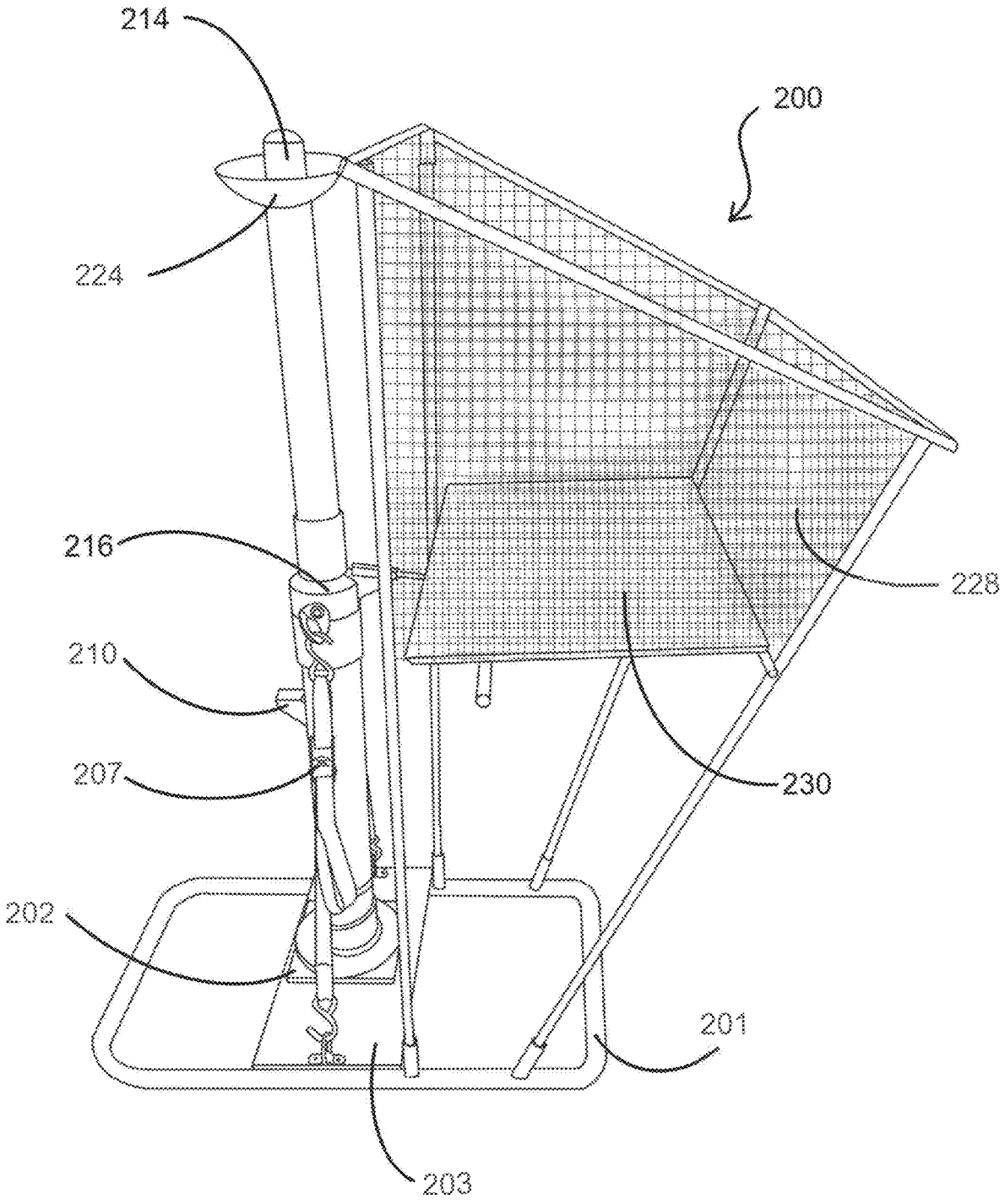
Figure 8:
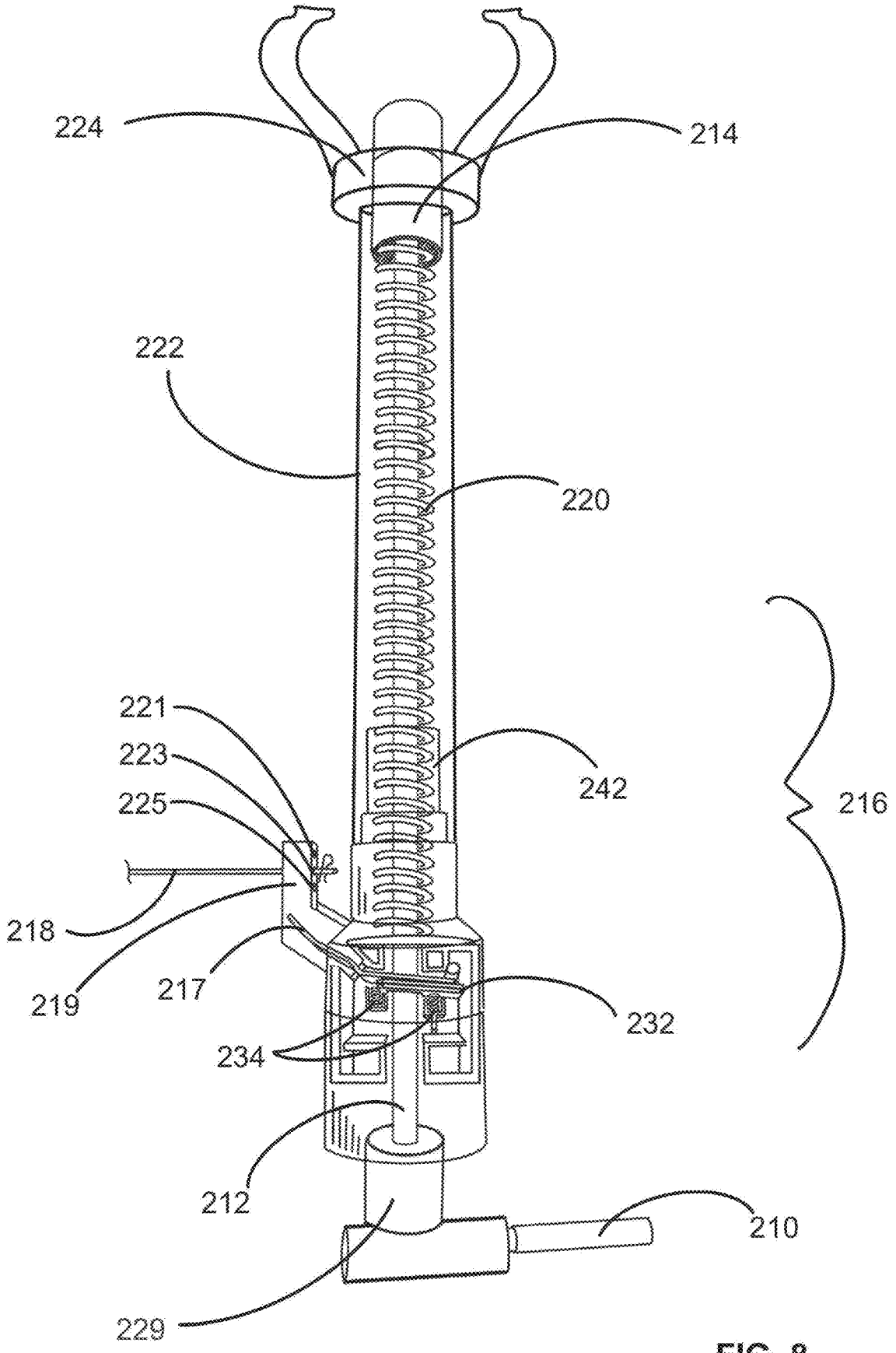
FIG. 8 is an enlarged partial side view of a volleyball launcher in accordance with another embodiment of the invention.

FIGS. 6-8 illustrate an interactive volleyball feeder system 200 in accordance with another embodiment of the invention. Open-framed base 201 provides a stable platform with a raised center area 203 designed to accommodate the launcher apparatus. The launcher rests on the adjustable angle plate 202, which is attached to the raised center area 203, allowing the plate to rotate from side to side. It is secured to the base using adjustment straps 207. The launcher base 201 features a compact footprint and can accommodate up to two launchers side by side if desired, and described herein in connection with FIG. 11.

The adjustable angle plate 202 is shown being located in the center of the base 201 and can rotate along a central raised area 203, allowing the launcher to be positioned to propel volleyballs to either side of the court.

Angle adjustment straps 207 can be cam buckle tie-down straps that secure the launcher apparatus to the launcher base on two sides. The straps enable quick manual adjustment of the trajectory angle by extending the length of one strap while shortening the other.

The launcher lower section 206 is a semi-enclosed tube with a slit running the length of the tube. This section provides a protected area for the striker rod 212 and priming pedal 210 to operate. As described herein with reference to FIGS. 9A-9D, the launcher's upper section 222 can be separated from the lower section 206 and stored therein, reducing the overall length during transportation and storage.

The power selector 208 is an adjustable band clamp that can be fastened at any position along the launcher's lower section 206. It controls the ball's vertical trajectory by limiting the compression of the launcher spring.

The priming pedal 210 is situated at the lower end of the striker rod 212, and the player uses their foot to prime the launcher by depressing the pedal. This action draws the striker rod 212 down the launcher's lower section 206 to compress the launcher spring 220. The amount of compression is limited by the power selector 208, or if the power selector is absent, a spring stop 242.

The pedal, striker rod, and channel cooperate together to facilitate vertically straight up and down movement within the launcher's lower section 206, preventing damage to the striker rod from the force exerted while priming the launcher. Additionally, in embodiments, the pedal comprises a pedal attachment such that a portion of the pedal can be removed to make the launcher more compact for transport.

The striker rod 212 serves as the primary moving component of the launcher functioning, in a sense, like an arrow and bow. The rod 212 is drawn back within the launcher's lower section, compressing and thereby loading the launcher spring 220. Upon release by the activation trigger 217, the rod 212 is propelled upward with sufficient momentum to drive a volleyball vertically by striking it from below. Optionally, a shock absorbing pad 229 is arranged between the priming pedal 210 and the striker rod 212 to dampen the striker rod's 136, upward momentum.

The striker head 214 is fixedly arranged on top of the striker rod. The head 214 features a cavity designed to hold the top of the spring 220 (in a sense like an arrow's nock), to transmit power from the spring to the rod. The exterior diameter of the head 214 is precisely selected relative to the inner diameter of the spring cover 222, to ensure that the rod assembly moves freely and remains aligned within the spring cover during priming and activation of the launcher. In embodiments, the gap between the outer diameter of the head 214 and the inner diameter of the spring cover 222 is less than 5 mm, more preferably less than 2 mm, and in some embodiments is about 1 mm. A rounded top of the head 214 provides consistent contact with the volleyball.

The trigger assembly 216 is operable to securely hold the striker rod 212 at any position along its travel during priming of the launcher until released/activated by the trigger 217. An assembly of clutch plates 232 and trigger springs 234 permits downward travel of the striker rod 212 but impedes any upward movement until the assembly is released by the trigger 217. This design serves to ensure the launcher's safety during operation. Even if the priming is interrupted by the player's foot disengaging from the pedal, the launcher will not activate unless the trigger is depressed.

An activator arm 218 is shown extending from the trigger 217 of the trigger assembly 216. The activator arm can be used to deflect the trigger in order to activate the launcher. This arm 218 can be manually operated or used together with the activator basket 228. When coupled to the activator basket, the launcher is triggered by tossing a volleyball into the basket. The force from the ball depresses an activator plate 230 beneath the basket, which deflects the arm 218 and trigger 217, which then releases the striker rod 212.

With reference to FIG. 8, in embodiments, a trigger adapter 219 couples the activator arm 218 to the trigger 217 of the activator assembly 216. The trigger adapter 219 is shown featuring a plurality of selectable attachment positions 221, 223, 225 for receiving the activator arm at different elevations because, as the launcher assembly is tilted for different trajectory angles, the effective height of the trigger 217 and trigger adapter is changed while the activator basket's height remains constant. Thus, in order to conveniently couple the actuator arm 218 to the adapter 219, the user can select an optimal attachment position 221, 223, or 225 for inserting the arm. In embodiments, the arm 218 can be adjustable in length and flexibility in order to couple a trigger plate to the actuator assembly 216.

As described herein the launcher spring 220 is a compression spring that serves to drive the striker rod 212 upward with enough force to propel a regulation-sized volleyball to a target height. An exemplary range for the target vertical height is 10 to 30 feet and in some embodiments, approximately 25 feet when fully compressed.

As described herein, in embodiments of the invention, the actuator is configured and operable to project a volleyball 10-30 feet in the air. In view of the overall size and footprint of the apparatus, the spring is customized to provide an adequate force in view of the limited amount of deflection arising from a user depressing the pedal by foot. The inventor has customized a spring to provide sufficient force to eject the volleyball a predetermined vertical height ranging from 10-30 feet based on compressing the spring only 5-15 in. (depending on how far the user depresses the pedal and where set point stop is placed). An exemplary spring is a round wire, cylindrical compression spring made from carbon steel. Exemplary wire diameter ranges 0.1 to 0.2 in. Exemplary wire length ranges from 150 to 200 inches. Exemplary minimum tensile strength is about 258754 psi. Exemplary coil characteristic includes spring rate [lbf/in] of 4.0, spring index 10.54, natural frequency [Hz] of 24, and a mean coil diameter ranging from 1 to 2 in., and preferably about 1.4 inches. The number of coils can vary widely and in embodiments, ranges from 30 to 50 coils, and preferably ranges from 40 to 45 coils. Exemplary pitch is about 0.5 in. and exemplary pitch angle is about 7 degrees. In embodiments, the uncompressed length of the coiled spring ranges from 15-25 in, and optionally is about 20-25 in.

The spring cover 222 houses the launcher spring 220 and striker rod 212. The cover 222 also guides the striker head 214 and rod 212 as the launcher is primed and activated. In embodiments, the spring cover 222 guides the striker head 214 directly beneath the ball for a centered impact with the volleyball. In embodiments, the striker rod 212 has holes along the shaft to allow air to escape during upward thrust.

The ball holder 224 is affixed to the top of the spring cover 222 and has a bowl-shaped body to hold the volleyball in alignment with the striker rod 212. The striker head, as described herein, is movable to extend through the ball holder to contact the center of the bottom of the volleyball The activator basket 228 can be a collapsible metal frame structure with a net mesh, and connectable to the launcher base 201. The basket is intended to catch and hold one or more regulation-sized volleyballs when tossed therein. Below the basket 228, an activator plate 230 transfers the force of the tossed ball to the activator arm 218, releasing the striker rod 212.

The activator plate 230 can be a lightweight, rigid plate located beneath the activator basket 228 and about the same size as the bottom dimension of the basket. In embodiments, the plate 230 is anchored to the basket frame on one side and hangs free on the other (or cantilevers). The free-hanging side is placed on the activator arm 218 and enables the activation of the launcher by transferring the force of a tossed volleyball into the activator basket to the activator arm. The plate 230 allows the basket to be a sufficient size target for a tossed volleyball while transferring the necessary force to the activation arm to launch the ball.

Storage

FIGS. 9A-9D are illustrations in sequence of a volleyball launcher being installed from a storage configuration to an operating configuration in accordance with an embodiment of the invention.

Figures 9A, 9B, 9C, 9D:
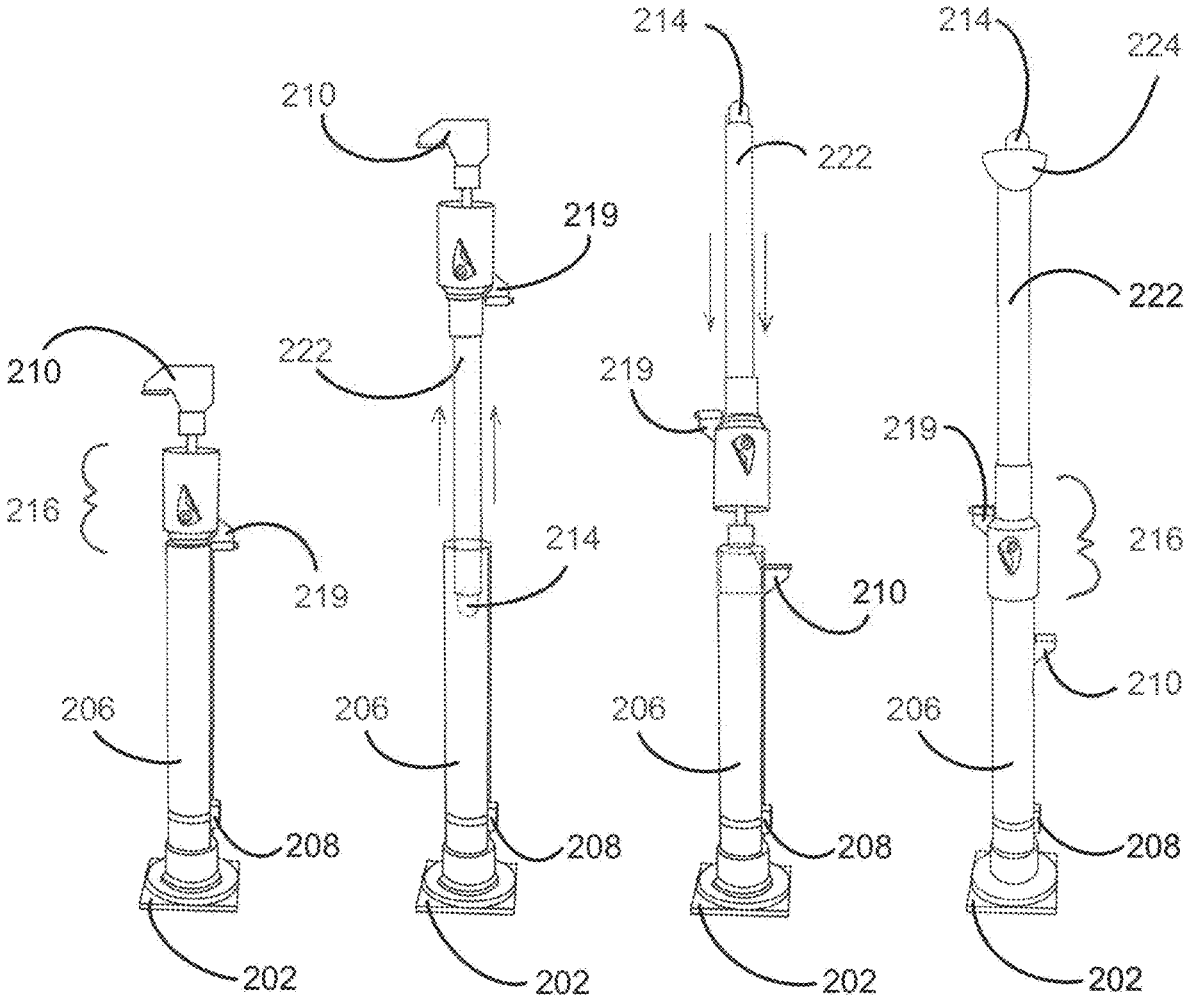
FIGS. 9A-9D are illustrations in sequence of a volleyball launcher being installed from a storage configuration to an operating configuration in accordance with an embodiment of the invention.

FIG. 9A shows a launcher in an initial compact configuration in which the spring cover 222, striker rod, and striker head 214 have been inserted upside down into the lower half of the launcher, namely, the hollow tubular launcher lower section 206. The priming pedal 210, actuator assembly 216, and trigger 219 are shown upside down, adjacent to, and protruding from the upper end of the lower section 206.

FIG. 9B illustrates the upper half being retracted from the lower section 206.

FIG. 9C illustrates the upper half being connected to the lower section 206 according to the proper orientation with the striker head facing up.

FIG. 9D shows the upper half and lower section 206 assembled in an extended or deployed configuration where the striker rod and striker head 214 are shown extended. The trigger 219 may now be coupled to a target surface such as the trigger plate and optionally, via a trigger extension arm not shown. The priming pedal 210 is ready to be depressed to prime the actuator assembly 216 as described herein.

The launcher may be disassembled in the reverse order to reduce the size of the launcher for transportation and storage.

Free Standing Basket Assembly

Figure 10:
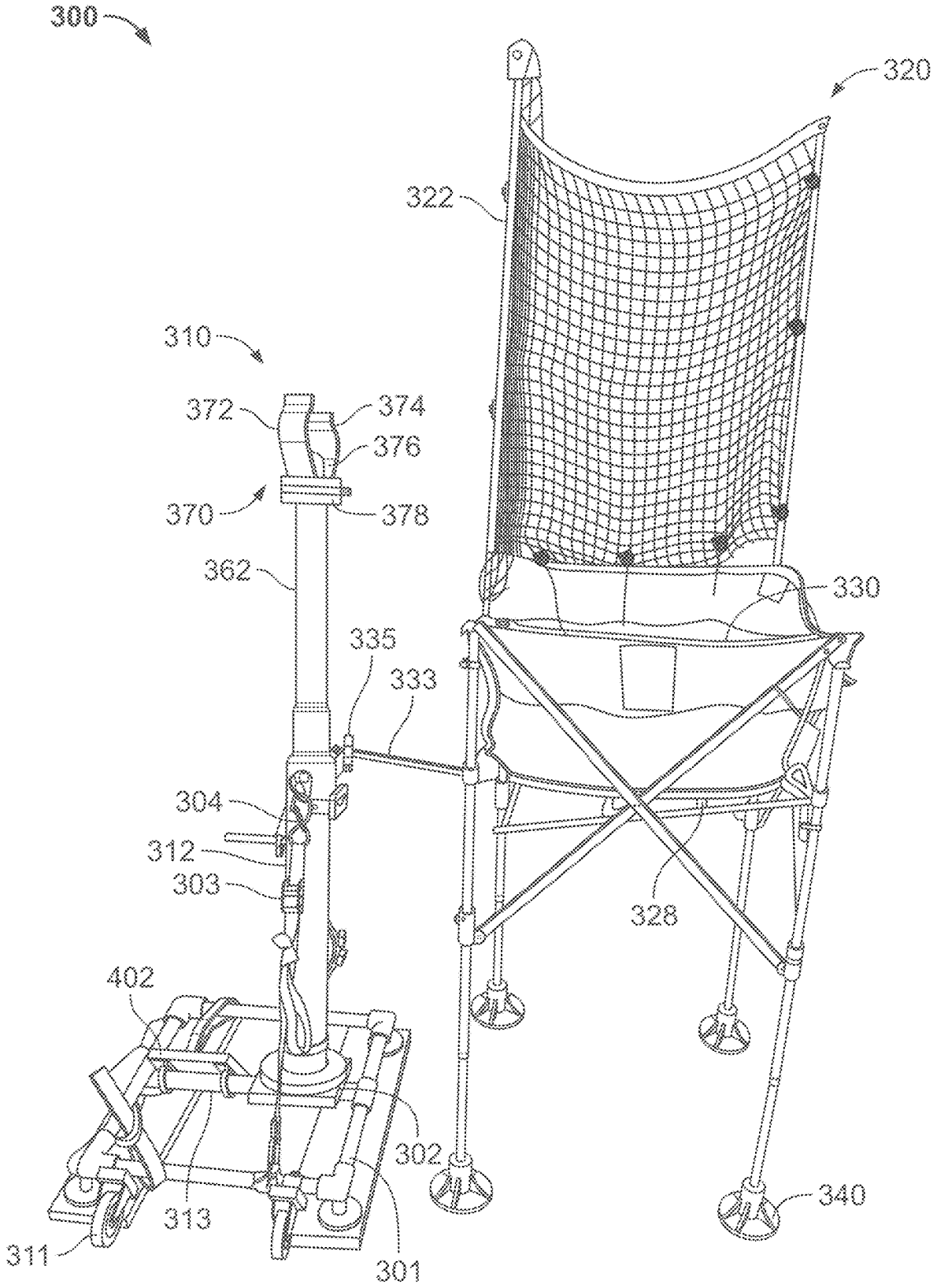
FIG. 10 is an upper left-side perspective view of an interactive volleyball system having a free-standing basket assembly in accordance with another embodiment of the invention.

FIG. 10 illustrates another interactive volleyball feeder system 300 comprising a launcher 310 and a free-standing basket assembly 320. Except for some of the components described below, the system 300 is similar to the launcher systems 100, 200 described above.

Unlike the basket assemblies described above, the basket assembly 320 is free standing (i.e., standing independently from the launcher base 301) and includes detachable backstop 322.

The backstop 322 can be made of a mesh net and frame members, and is preferably removable from the basket 330 for transportation and storage. Optionally, feet 340 are coupled to the bottom of the basket legs for stability. The feet 340 have a flange shape with a flat circular bottom. In some embodiments, the feet taper to a point or spike for penetrating a grass or sand court.

Collectively, the basket and backstop are operable to catch and hold at least one regulation-sized volleyball when tossed therein. An activator plate 328 is arranged below the basket 330. The activator plate 328 transfers the force of the tossed ball to the activator arm 333, releasing the striker rod within the launcher assembly 310 as described above. In embodiments, the activator arm can be telescoping or adjustable in length in order to adjust the distance between the basket assembly 320 and the launcher. Additionally, an adapter 335 can comprise holes or connectors located at different elevations along the adapter so that the arm 333 may be securely coupled to the trigger even if the launcher assembly is tilted relative to the base frame. The change in elevation arising from the tilt can be compensated by the size and position of holes to receive the arm in the adapter.

FIG. 10 also shows adjustable length straps 312 and clips 304 for securing the launcher tower at a desired angle relative to the base frame 301. The launcher is tiltable about axis 313 and can be secured at a desired angle by adjusting the length of the straps 312 using clamp or buckle 304.

FIG. 10 also shows a ball holder 370. The ball holder 370 comprises a cap 378 mounted to the rod/spring cover 362. Two flexible arms 372, 374 extend from the cap and serve to hold the volleyball in alignment with the striker rod/head 376. Each arm 372, 374 has a thin concave shape. The arms cooperate together to provide enough pressure to prevent the volleyball from falling off the launcher yet are light enough to not inhibit the ball's trajectory. An exemplary material for the arms is steel or a thermoplastic such as PVC. The combination of the ball holder grip 370 and the centered impact from the striker head 376 results in launching the volleyball with zero rotation, creating what is typically considered a perfect set.

In embodiments, the length of each arm ranges from 3-8 inches. In embodiments, the arms are spaced apart a distance (d) where d ranges from 5-8 inches. In one embodiment, each arm is 2.5 in. wide and extends 5.5 in. from the top edge of the ball holder base. In one embodiment, the opening of the arms is 6.25 in. and the widest distance is 7.75 in.

Figure 11:
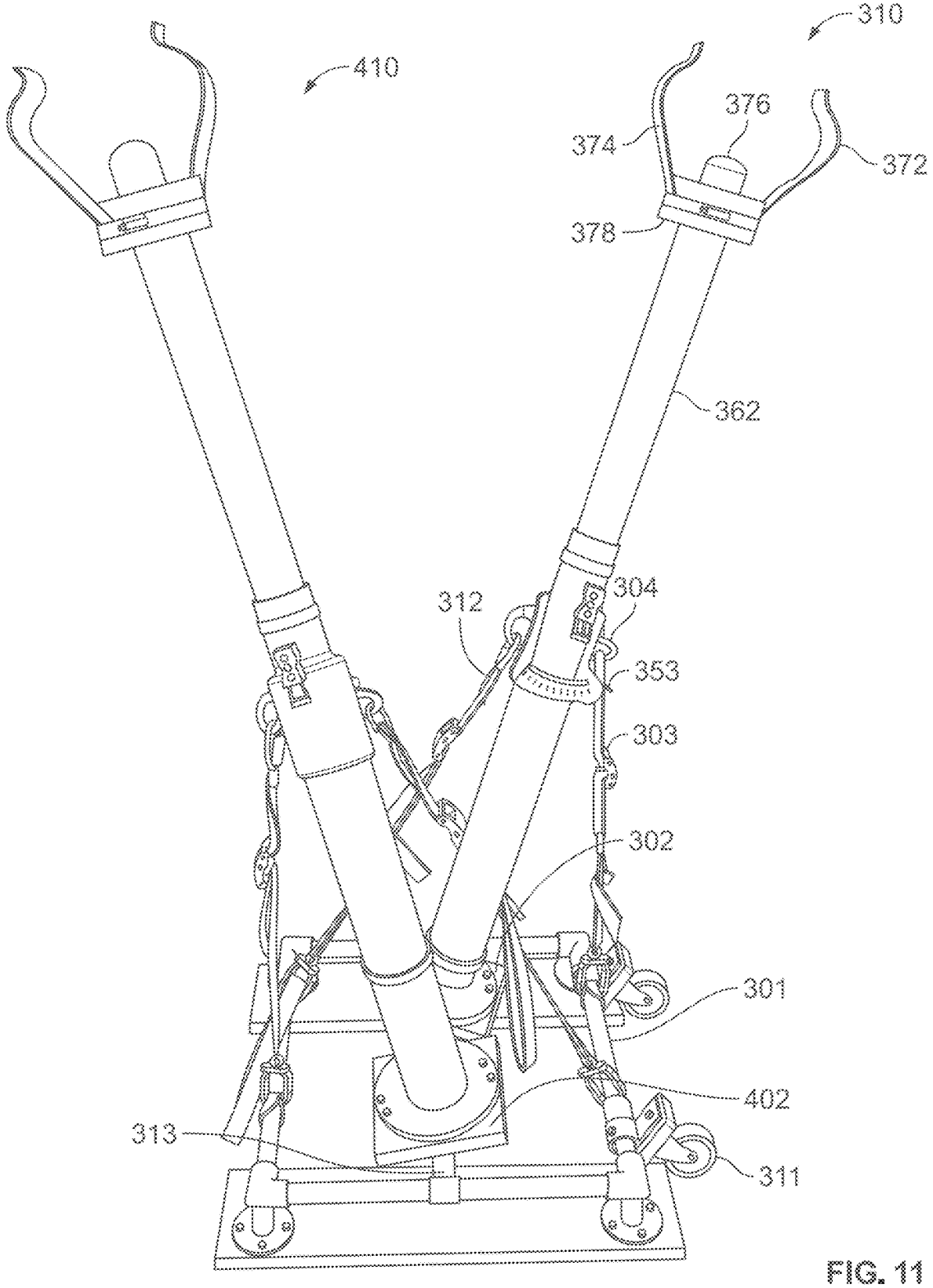
FIG. 11 is an enlarged rear view of two volleyball launchers arranged on a base assembly in accordance with an embodiment of the invention.

FIG. 11 is an enlarged rear view of the volleyball launcher 310 described above in FIG. 10 except that a second volleyball launcher 410 is also mounted to the base assembly 301 in accordance with an embodiment of the invention. The second launcher 410 shown in FIG. 10 is identical to the first launcher 310 except mounted at an angle opposite the first launcher to set a volleyball to the opposite side of the net from the first launcher. As described herein, each of the launchers may be adjusted to provide an accurate consistent parabolic trajectory based on the tilt angle, and pre-selected loads. In embodiments, an inclinometer 353 is provided to measure the tilt angle. The load can be set as described above using load control pin 120 or band 208. Alternatively, the tilt may be measured using a smart phone App using its camera or optionally, attaching the phone to the actuator assembly 216 or rod cover 362 and using a level App.

Alternative Embodiments

The shape of the target surface or trigger plate may vary widely. In some embodiments, the trigger plate may take a circular, oval, or another shape.

Additionally, although the trigger plate is shown in some of the figures as a floor of the net, it need not be so arranged. In other embodiments, the trigger plate may be positioned at an angle to horizontal (e.g., vertical). Additionally, unless otherwise excluded by the claims, multiple discrete target surfaces may be provided in the basket assembly and linked to the actuator assembly. Indeed, the shape of the trigger plate or target surface may vary widely and may be arranged with a basket or in some embodiments, without a basket in which contacting the target surface would activate the volleyball launcher.

Although only two arms 372, 374 are shown in FIGS. 10-11, the ball holder may have more arms. In some embodiments, the ball holder comprises 3 or four arms.

Although only two launchers 310, 410 are shown in FIG. 11, the system may have more than two launchers. In some embodiments, the system comprises 3 launchers to set volleyballs to each side, and middle.

In embodiments, sandbags can be used on the base plate to stabilize the launcher. Empty sandbags can be used for parts storage with the carrying case during transportation.

An accessory mount, optionally pole mount, can be attached the base plate 102, and allows the user to attach different types of devices to the base. It can include straps or clamps and a support (optionally flat, or comprising a cavity and/or mounting holes) upon which to securely affix the accessory. Accessories can include, without limitation, a phone, action camera, speaker, or light. In embodiments, the accessory pole is formable and can be bent or positioned at an angle to hold its shape. Exemplary configurations for the accessory pole are a collapsible hollow metal tube(s) or a metal wire bundle enclosed by a flexible sheath.

Embodiments of the invention include methods for one or more users to set up, use (to pass, set, hit, and or block), disassemble, collapse, transport and store the interactive volleyball system and components therein as described herein.

Throughout the foregoing description, and for the purposes of explanation, numerous specific details are set forth in order to provide a thorough understanding of the described techniques. It will be apparent, however, to one skilled in the art that these techniques can be practiced without some of these specific details. Although various embodiments that incorporate these teachings have been shown and described in detail, those skilled in the art could readily devise many other varied embodiments or mechanisms to incorporate these techniques. Also, embodiments can include various operations as set forth above, fewer operations, or more operations; or operations in another order than that specifically described above. Additionally, any of the components and steps described herein may be combined with one another in any logical manner except where such components or steps would be exclusive to one another. Accordingly, the scope and spirit of the invention should be judged in terms of the claims, which follow as well as the legal equivalents thereof.

The invention claimed is:

1. An automatic volleyball feeder system for sending a first volleyball in the air along a trajectory for a player to hit, the feeder system comprising:

a volleyball launcher comprising:
- an actuator assembly;
- a base assembly;
- a tubular shaped body mounted to the base assembly;
- a compressible launcher spring arranged within the tubular shaped body;
- an axially movable striker shaft arranged within the launcher spring of the tubular shaped body;
- a priming lever fixed to the striker shaft and operable to compress the launcher spring according to a downward distance the priming lever is depressed along the tubular shaped body; and
- a trigger assembly operable with the actuator assembly to release the launcher spring when loaded, thereby launching the first volleyball along the trajectory; and wherein the actuator assembly further comprises spring-loaded clutch plates that constantly frictionally engage the striker shaft to securely hold the striker shaft at any position of downward travel during loading even if the priming lever is unintentionally released during loading;

a hand-adjustable load control member to limit compression of the launcher spring, and a target assembly comprising:
- a target member that is in cooperating engagement with the trigger assembly of the volleyball launcher to activate the actuator assembly when a second volleyball is received by the target assembly and contacts the target member, and wherein the target assembly further comprises:
- a basket, and the target member is arranged at the bottom of the basket such that the second volleyball received by the target assembly is guided into contact with the target member within the basket; and an extension member detachably coupled to the actuator assembly and the target member of the target assembly;

a trigger adapter operable to adjust elevation at which the extension member is coupled to the actuator assembly and without limiting the downward distance that the spring is compressed;

wherein the volleyball launcher sends the first volleyball into the air along the trajectory when activated.

2. The feeder system of claim 1, wherein the volleyball launcher is rotatably mounted to the base assembly.

3. The feeder system of claim 2, further comprising a second volleyball launcher rotatably mounted to the base assembly.

4. The feeder system of claim 2, further comprising straps operable to set the volleyball launcher at a desired angle relative to the base assembly.

5. The feeder system of claim 2, wherein the target assembly is mounted to the base assembly.

6. The feeder system of claim 1, wherein the hand-adjustable load control member to limit compression of the launcher spring is a band clamp or a pin.

7. The feeder system of claim 1, wherein the volleyball launcher further comprises a ball holder shaped for (a) releasably gripping the first volleyball and (b) avoiding applying rotation to the first volleyball as the first volleyball is launched.

8. The feeder system of claim 7, wherein the volleyball holder comprises a cap and a plurality of elongate flexible arms extending from the cap, wherein the elongate flexible arms apply pressure to the sides of the first volleyball.

9. The feeder system of claim 7, wherein said ball holder shape for releasably gripping and avoiding applying rotation comprises opposing arms applying pressure to the sides of the volleyball when the volleyball is held by the ball holder.

10. The feeder system of claim 1, wherein the actuator assembly is operable to launch the volleyball from 10 to 20 feet in the air.

11. The feeder system of claim 1, wherein the target member is a plate.

12. The feeder system of claim 1, wherein volleyball launcher, when assembled, occupies less than 3 sq. ft.

13. The feeder system of claim 1, wherein volleyball launcher has a weight of less than 15 lbs.

14. The feeder system of claim 1, further comprising a backstop detachably connectable to the basket.

15. The feeder system of claim 1, further comprising at least one air vent in the striker shaft.

* * * * *